US009860651B2

(12) United States Patent
Marcher et al.

(10) Patent No.: US 9,860,651 B2
(45) Date of Patent: Jan. 2, 2018

(54) BEHIND THE EAR HEARING AID

(71) Applicant: Widex A/S, Lynge (DK)

(72) Inventors: Ib Marcher, Herlev (DK); Peter Nordland Jensen, Kastrup (DK); Klaus Henrik Vaarbroe, Skovlunde (DK)

(73) Assignee: Widex A/S, Lynge (DK)

( * ) Notice: Subject to any disclaimer, the term of this patent is extended or adjusted under 35 U.S.C. 154(b) by 25 days.

(21) Appl. No.: 14/844,213

(22) Filed: Sep. 3, 2015

(65) Prior Publication Data

US 2015/0382112 A1 Dec. 31, 2015

Related U.S. Application Data

(63) Continuation-in-part of application No. PCT/EP2013/076242, filed on Dec. 11, 2013, and a continuation-in-part of application No. PCT/EP2013/055756, filed on Mar. 20, 2013.

(51) Int. Cl.
*H04R 25/00* (2006.01)
*H04R 25/02* (2006.01)

(52) U.S. Cl.
CPC ..... *H04R 25/02* (2013.01); *H04R 25/60* (2013.01); *H04R 25/652* (2013.01); *H04R 2225/021* (2013.01); *H04R 2225/63* (2013.01)

(58) Field of Classification Search
CPC ..... H04R 25/02; H04R 25/60; H04R 25/65; H04R 25/652; H04R 2225/021; H04R 1/1016
See application file for complete search history.

(56) References Cited

U.S. PATENT DOCUMENTS

2008/0170734 A1 7/2008 Major et al.
2010/0086161 A1 4/2010 Ilic et al.
(Continued)

FOREIGN PATENT DOCUMENTS

EP 1816893 A1 8/2007
EP 2117258 A1 11/2009
(Continued)

OTHER PUBLICATIONS

International Search Report and Written Opinion of International Searching Authority for PCT/EP2013/076242 dated Feb. 18, 2014.
(Continued)

*Primary Examiner* — Matthew Eason
(74) *Attorney, Agent, or Firm* — Sughrue Mion, PLLC

(57) ABSTRACT

A hearing aid (1) comprising a behind-the-ear part (2), an in-the-ear part (3) and a connecting part (4) connecting the behind-the-ear part and the in-the-ear part. The in-the-ear part comprises a first end (7) adapted to be aligned in the ear canal in a direction towards the ear drum when in use, and a second end (8) adapted to abutting a part of the ear outside the ear canal when in use. At least one side wall (15, 16) is arranged between said first end (7) and said second end (8). The direction from a centre of the first end to a centre of the second end defines an axis. The connecting part (4) is attached to the side wall and is extending from this side wall in an angle to the axis between 20-70 degrees. The invention also provides a receiver unit for a hearing aid and a method for fitting a hearing aid.

19 Claims, 7 Drawing Sheets

(56) References Cited

U.S. PATENT DOCUMENTS

| | | | | |
|---|---|---|---|---|
| 2011/0007919 | A1* | 1/2011 | Aquilina | H04R 25/65 381/324 |
| 2012/0237065 | A1 | 9/2012 | Higgins et al. | |
| 2012/0237068 | A1* | 9/2012 | Fretz | H04R 25/656 381/330 |

FOREIGN PATENT DOCUMENTS

| | | | |
|---|---|---|---|
| JP | S44-24313 | A | 10/1969 |
| JP | S52-022403 | A | 2/1977 |
| WO | 2008/095505 | A1 | 8/2008 |
| WO | 2009/083008 | A1 | 7/2009 |

OTHER PUBLICATIONS

International Search Report for PCT/EP2013/055756 dated Aug. 19, 2013.
Communication from the Japanese Patent Office dated Oct. 4, 2016 in JP 2016-503561.

* cited by examiner

BEHIND THE EAR HEARING AID

RELATED APPLICATIONS

The present application is a continuation-in-part of International Application No. PCT/EP2013/076242, filed on Dec. 11, 2013, and published as WO 2014/146741 A1. The present invention is also a continuation-in-part of International Application No. PCT/EP2013/055756, filed on Mar. 20, 2013, and published as WO 2014/146702, the contents of both of which are incorporated here by reference.

BACKGROUND OF THE INVENTION

1. Field of the Invention

The present invention relates to hearing aids. The invention in particular relates to hearing aids comprising a behind-the-ear part adapted to be arranged behind the ear of a hearing aid user, an in-the-ear part adapted to be arranged in the ear canal or at the entrance to the ear canal, and a connecting part connecting the behind-the-ear part and the in-the-ear part. The invention further relates to a receiver unit for a hearing aid. The invention, still further, relates to a method for fitting a hearing aid.

In the context of the present disclosure, a hearing aid should be understood as a small, microelectronic device designed to be worn behind or in a human ear of a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a microelectronic circuit comprising a signal processor, and an acoustic output transducer, in the hearing aid parlance referred to as a receiver. The signal processor is preferably a digital signal processor.

2. The Prior Art

WO2008/095505 A1 discloses a hearing aid of the Receiver-in-the-Ear (RITE) type, where a behind-the-ear part comprises microphone, signal processor and power supply, and an electrical cable transfers the output signal to a receiver arranged in the ear canal. In this type of hearing aids the cable is often given a shape and stiffness adapted to assist in holding the hearing aid in the preferred position.

When using a behind-the-ear hearing aid there is a connection to an in-the-ear part. This connection may be an electrical cable in the case where the receiver is arranged in the in-the-ear part. The connection may be a sound tube in the case where the receiver is arranged in the behind-the-ear part. The sound tube will guide sound generated in the receiver to an instant fit ear mold or dome in the ear canal.

In both cases the audiologist would typically fit the connection in length and shape to be easily arranged in close contact with the ear. This will be for cosmetic reasons, and also because this will assist in holding the hearing aid in the correct position. However, it is often difficult to obtain this close contact between the connection and the outer ear.

In most known solutions the connection will extend from the end of the ear part prepared for pointing away from the ear drum when in use. The connection will typically extend substantially parallel with a longitudinal axis of the in-the-ear part. This longitudinal axis would extend from one end to the other of the in-the-ear part. In a few products the connection has extended in an angle of 90 degrees. It is however often the case that the in-the-ear part will move when the hearing aid user is chewing or talking. This is in general a problem in the wearing of hearing aids, i.e. lateral migration of the in-the-ear part.

It is typical to apply an anchor for further securing the position of the in-the-ear part. This anchor is typically arranged in the concha part of the outer ear. This anchor makes the hearing aid more annoying to wear and also more visible. The anchor would typically be a wire or plastic strip shaped and prepared individually to fit into the concha part and supporting the in-the-ear part.

SUMMARY OF THE INVENTION

The invention, in a first aspect, provides a hearing aid comprising a behind-the-ear part adapted to be arranged behind the ear of a hearing aid user, an in-the-ear part adapted to be arranged at least partially in the ear canal, said in-the-ear part comprising a first end surface in which a sound opening for guiding the sound from the hearing aid in the direction of the ear drum is arranged, and a second end surface, which is the surface situated furthest away from the first end surface, and a connecting part connecting the behind-the-ear part and the in-the-ear part, wherein said first end surface is adapted to be aligned in the ear canal in a direction towards the ear drum when in use, and said second end surface is adapted to abut a part of the ear outside the ear canal when in use, wherein at least one side wall is arranged between said first end surface and said second end surface, and wherein said connecting part is attached to said side wall and has a part that extends from said side wall in an angle of between 20-70 degrees from an axis extending from a center of the first end surface to a center of the second end surface.

By this solution a very stable positioning of the in-the-ear part can be achieved, and lateral migration of the ear canal part during chewing or talking can be avoided. Furthermore, the use of an anchor can be avoided.

The above does not exclude that part of the connecting part may extend from part of the second end surface. A major achievement is that it will be possible to arrange the hearing aid in a very stable position avoiding the use of any anchor or any other fastening or securing means, other than the in-the-ear part, the connection part and the behind-the-ear part by themselves. Especially, any securing means supporting the in-the-ear part in the concha can be avoided. Supporting of the in-the-ear part inside the ear canal, e.g. in the form of an open ear plug in a soft material, may however be preferred in many situations. This is also called an instant fit ear plug, and keeps the sound exit centered when the in-the-ear part is arranged in the ear canal.

In an embodiment of the invention the second end of said in-the-ear part is adapted to abut the tragus part of the outer ear. Thereby the in-the-ear part is held in a very stable position.

In an embodiment of the invention the hearing aid is adapted to be arranged at the ear without the use of an anchor. This will be more comfortable to the hearing aid user, as well as less visible, and will facilitate cost savings. In a further embodiment the hearing aid is adapted to be arranged at the ear without any supporting elements in the concha other than said second end abutting a part of the ear outside the ear canal and said connecting part.

In a further embodiment a receiver is arranged in said in-the-ear part, and said connecting part comprises an electrical cable connecting the receiver with the behind-the-ear part. The receiver would typically be arranged in a receiver housing. This gives the further advantages of a RITE hearing aid.

In a further embodiment the connecting part is extending from the side wall in an angle between 30-60 degrees. This range has been found to be particularly beneficial for the arrangement of the in-the-ear part. In a further embodiment the connecting part is extending from the side wall in an angle between 40-50 degrees.

In a further embodiment the receiver is provided with an extension part at said second end in order for this extension part to abut said part of the ear outside the ear canal when in use. This provides the possibility of fitting small receiver units to persons with a larger than average distance from the ear canal to the tragus part, and achieve the benefits of the abutment against the tragus part.

In an embodiment the connecting part is extending only from one or more side walls, while no part of the connecting part extends from the second end.

In a second aspect, the invention provides a receiver unit for a hearing aid, where the receiver unit comprises a first end adapted to be aligned in the ear canal in a direction towards the ear drum when in use, a second end adapted to abut a part of the ear outside the ear canal when in use, and at least one side wall arranged between the first end and the second end, wherein an electrical cable is attached to the side wall and extends from the side wall in an angle of between 20-70 degrees to an axis extending from a center of the first end to a center of the second end.

In an embodiment of this receiver the electrical cable extends from said side wall in an angle between 30-60 degrees.

In an embodiment the second end of the receiver part is adapted to abut the tragus part of the outer ear.

In a third aspect, the invention provides a method for fitting a hearing aid a hearing aid comprising a behind-the-ear part adapted to be arranged behind the ear of a hearing aid user, an in-the-ear part adapted to be arranged at least partially in the ear canal, said in-the-ear part comprising a first end surface in which a sound opening for guiding the sound from the hearing aid in the direction of the ear drum is arranged, and a second end surface, which is the surface situated furthest away from the first end surface, and a connecting part connecting the behind-the-ear part and the in-the-ear part, wherein said first end surface is adapted to be aligned in the ear canal in a direction towards the ear drum when in use, and said second end surface is adapted to abut a part of the ear outside the ear canal when in use, wherein at least one side wall is arranged between said first end surface and said second end surface, and wherein said connecting part is attached to said side wall and has a part that extends from said side wall in an angle of between 20-70 degrees from an axis extending from a center of the first end surface to a center of the second end surface, comprising the steps of arranging the behind-the-ear part behind an ear of said person, shaping a connecting part connecting said behind-the-ear part to an in-the-ear part, such that said connecting part fits the outer ear of said person, and arranging said in-the-ear part at the entrance of the ear canal such that said in-the-ear part abuts the tragus part of the outer ear.

Embodiments of the invention will now be explained in further detail with reference to the figures.

DETAILED DESCRIPTION OF THE INVENTION

Figure 1:
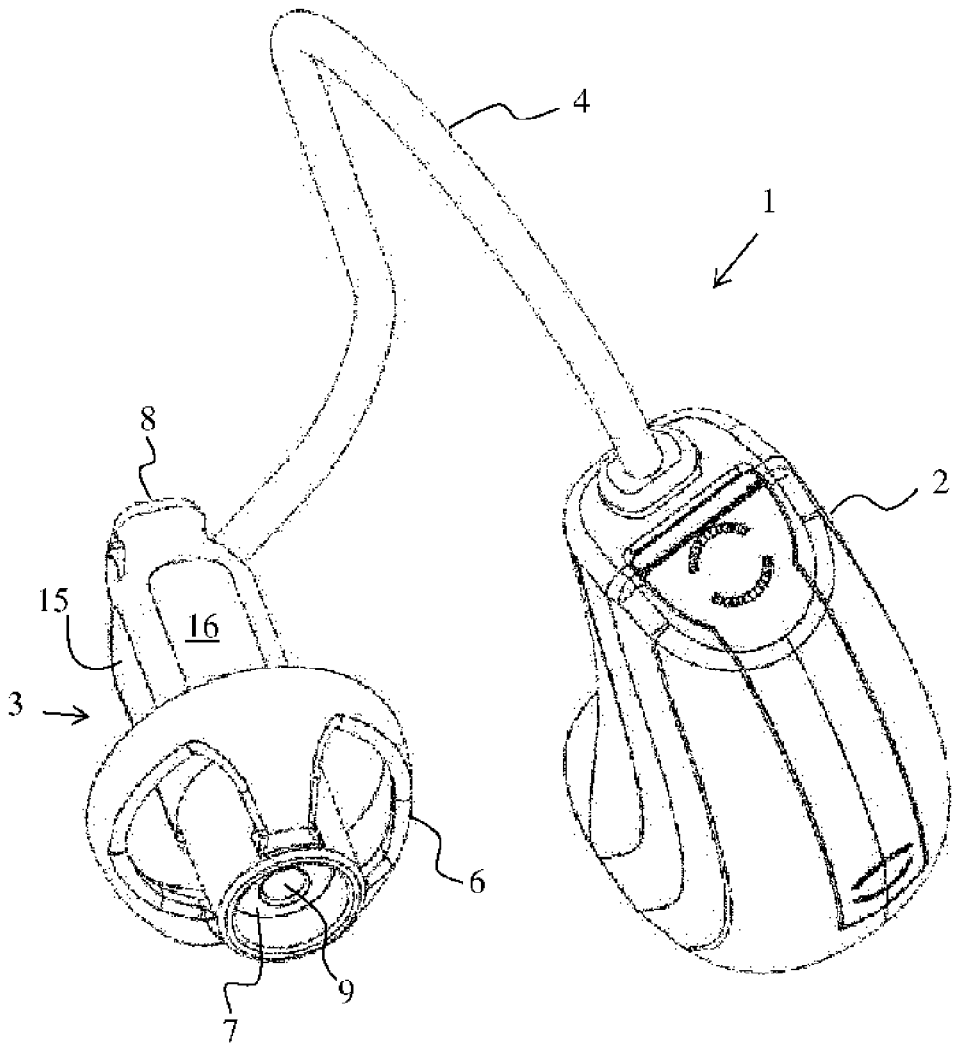
FIG. 1 illustrates a hearing aid with a behind-the-ear part, an in-the-ear part and a connection.

FIG. 1 shows a hearing aid 1 with a behind-the-ear part 2 and an in-the-ear part 3. The in-the-ear part 3 is here illustrated as a receiver 5 provided with an instant fit ear plug 6. It could also have been a custom fit ear mold. Sound from the receiver will pass through an opening 9 in the first end 7 of the in-the-ear part 3. The second end 8 of the in-the-ear part 3 is preferably smooth or substantially smooth without protrusions or indentations. Preferably there are also no sharp edges in the transition from the end 8 to the side walls 15, 16.

The connecting part 4 connecting the behind-the-ear part 2 and the in-the-ear part 3 will comprise electrical cables when the in-the-ear part 3 comprises a receiver 5. In case the receiver was arranged in the behind-the-ear part 2 the connecting part 4 would be a sound tube. In both cases the connecting part may be detachably attached or fixedly attached to the in-the-ear part 3. In case the in-the-ear part comprises a receiver and the connector comprises an electrical cable, a fixed attachment, e.g. by soldering the wires passing through the cable directly to the receiver, is often preferred, since this will take up less space than having a connection through a detachable connector or plug. In this case the cable would preferably be connected through a connector or plug to the behind-the-ear part in order to facilitate combining different types of receivers to the same behind-the-ear part in an easy way, and to facilitate easy replacement of a receiver.

Figure 2:
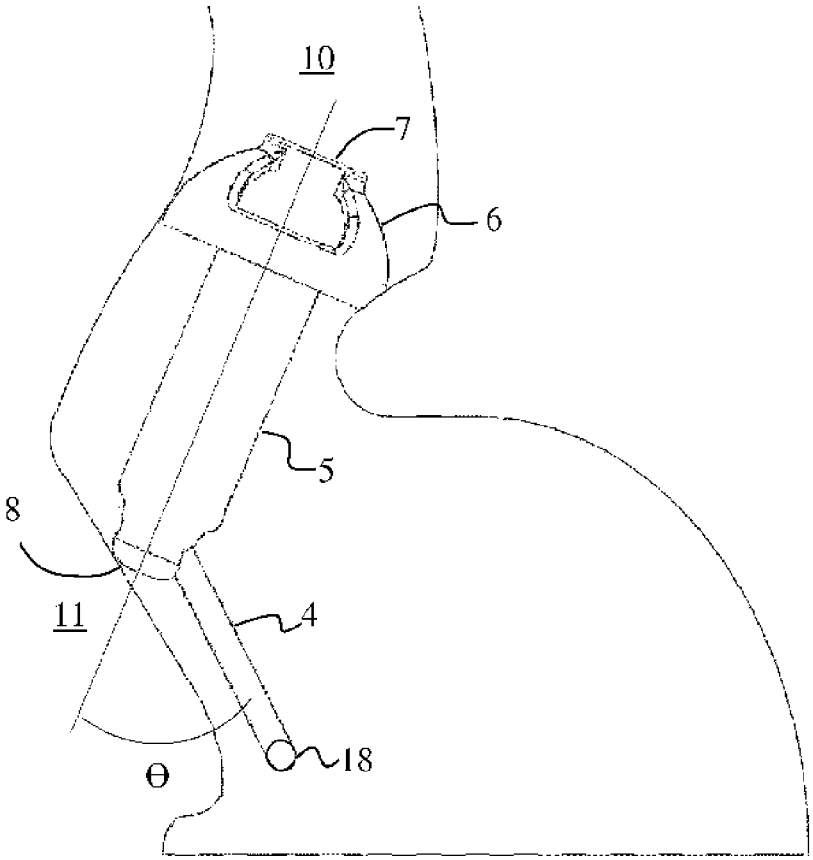
FIG. 2 illustrates a receiver arranged at the ear canal entrance.

FIG. 2 shows an example of an in-the-ear part 3 arranged at the entrance of the ear canal 10. A receiver 5 with an instant fit ear plug 6 is illustrated here. It is seen that the end 8 of the receiver housing opposite the direction to the ear canal is abutting slightly against a part of the outer ear 11. This part of the outer ear is often called the tragus 11. The end 8 of the in-the-ear part would typically abut against the part of tragus 11 facing the ear canal opening. This abutment helps keep the receiver in the correct position without any lateral migration, e.g. during chewing, talking, sports or sleeping. This position can be held without the use of an anchor or other supporting means.

FIG. 2 further shows the connecting part 4 in the form of an electrical cable attached to the receiver 5, and extending from the receiver in an angle $\theta$ between 20-70 degrees, preferably 30-60 degrees and more preferably 40-50 degrees, to an axis passing through, or substantially through, the center part of the two ends of the in-the-ear part 3. These two ends are here a first end 7 of the receiver 5 facing the ear canal and a second end 8 pointing away from the ear canal and partly abutting the tragus portion 11 of the outer ear.

The angle θ in the specified range between the cable and the receiver will assist in holding the receiver in the position where the second end portion 8 abuts the tragus part 11 of the outer ear. This is because such an angle will keep the connecting part 4, e.g. a cable or a tube close to the surface of the outer ear in a more natural way. The section of the cable or tube, close to the in-the-ear part preferably extends more or less parallel with the tragus surface against which the end portion abuts. The angle θ will facilitate guiding the cable or tube towards the area of the outer ear between the tragus and the crus of helix. For most human ears there will be an indent or a small divide between the tragus and the crus of helix. By application of the angle θ, it has been found to be relatively easy to guide the cable or tube through this indent or divide while keeping it close to the skin. This will offer a very stable positioning of the hearing aid with a reduced visibility of the cable or tube.

The connecting part meets the in-the-ear part at an angle θ. The part obeying this angle will extend for a distance of at least 3 mm, preferably at least 5 mm, more preferably at least 8 mm of the connecting part, before this is bent in any way. The circle 18 at the endpoint of the connecting part 4 in FIG. 2 illustrates that the connecting part here is bending out of the paper plane. If the purpose is to achieve the same advantages of abutment against the tragus part, the invention also covers an embodiment where the connecting part is fixed to a side wall of the in-the-ear part in a larger angle (than the 70 degrees), but has been bent permanently into the angle θ within a very short distance, e.g. 0.5 mm from the side wall.

As seen from FIG. 2 there will be more space for the abutment between the second end of the receiver and the tragus part of the outer ear when the cable is not connected to the receiver through this second end, but through a side wall relatively close to or adjacent to this second end. The number of side walls will be dependent on the shape of the receiver. If the receiver is circular or elliptic seen in a cross sectional view perpendicular to the axis shown in FIG. 2, then there is one side wall extending between the first end 7 and the second end 8. However, indentions and protrusions along the side of the receiver, or the in-the-ear part 3, could in principle create any number of side walls. FIG. 2 shows that the cable extends from a side wall adjacent to the second end 8 of the receiver.

Figure 3:
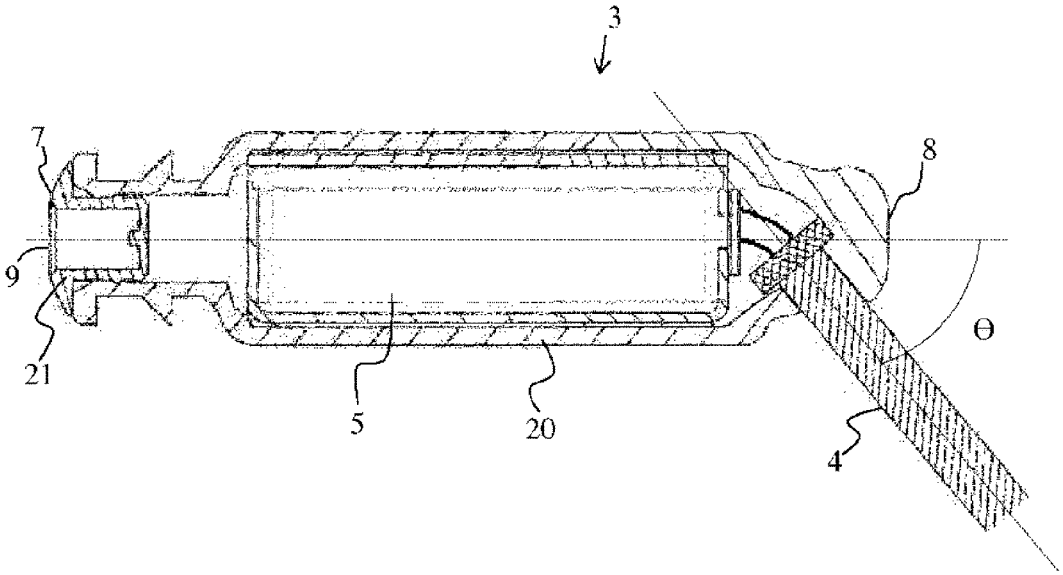
FIG. 3 illustrates a receiver in a receiver housing and with an electrical cable.

Defining when a wall of the receiver, or of the in-the-ear part, is an end part or is a side wall is relatively simple for the shape of the receiver illustrated in FIG. 2 or 3. If the shape of the end surfaces is more complex, the first end surface may be defined as the surface in which the sound opening for guiding the sound from the hearing aid in the direction of the ear drum is arranged. The second end surface would then be the surface situated furthest away in the opposite direction.

Also when the shape of the in-the-ear part does not follow a rectangular shape, the axis shown in FIG. 2 should pass through the first and the second end. This also holds if the overall shape of the in-the-ear part is curved, e.g. like a banana, or bent. At the middle of the in-the-ear part 3 the axis may therefore pass outside the in-the-ear part.

FIG. 3 shows an example of an in-the-ear part 3 with a part of the connecting part 4 extending from a side wall of the in-the-ear part. A receiver unit 5 is arranged in a receiver housing 20, where the receiver housing comprises a nose part accommodating an ear wax guard 21, for preventing ear wax from entering into the receiver unit 5. The ear wax guard 21 comprises a mesh for blocking. The first end 7 in the example of the in-the-ear part in FIG. 3 is thus equivalent to a flange part of the earwax guard. In this text the term receiver may include the receiver as well as a receiver housing.

FIG. 3 illustrates an axis extending from a center of the first end 7 to a center of the second end 8 of the in-the-ear part. FIG. 3 also illustrates a center axis of the connecting part, and how the angle θ is defined by these two axes.

Figure 4:
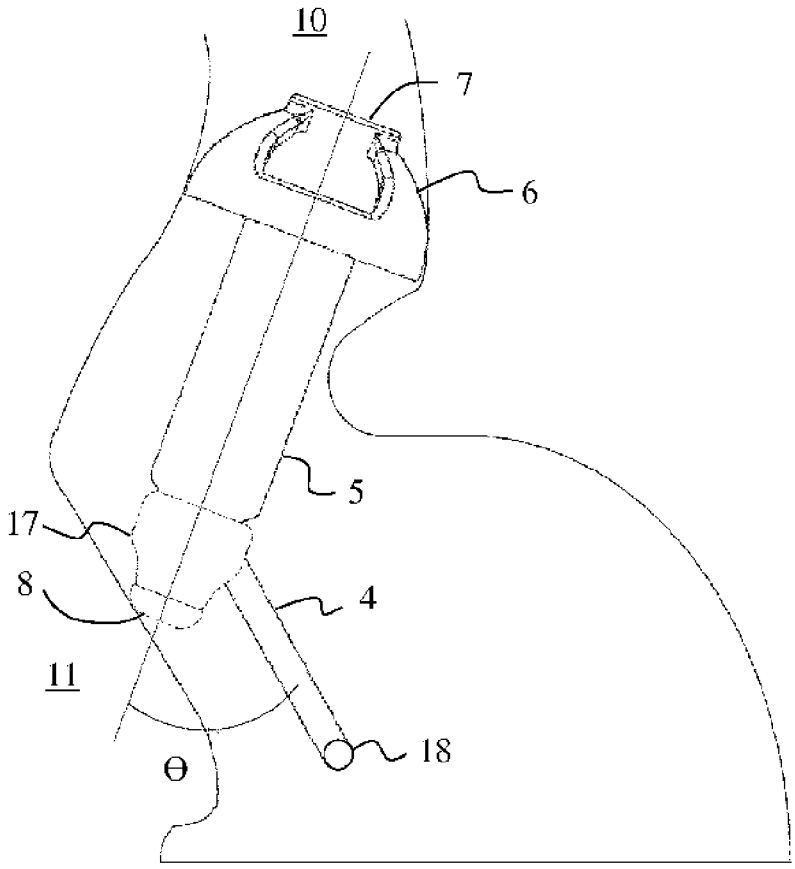
FIG. 4 illustrates a receiver provided with an extension piece arranged at the ear canal entrance.

FIG. 4 shows the receiver 5 with an instant fit ear plug 6 of FIG. 2 where the receiver is provided with an extension part 17 in order to extend the total length of the in-the-ear part, i.e. increase the distance from the first end 7 to the second end 8. This facilitates arranging in-the-ear parts in ears where the distance between the ear canal and the tragus part might be too large for achieving the abutment against the tragus part.

An extension part for this purpose would preferably be provided with an opening for the connecting part extending from a side wall of the in-the-ear part to pass through. This opening may be in the form of a slit.

Figure 5:
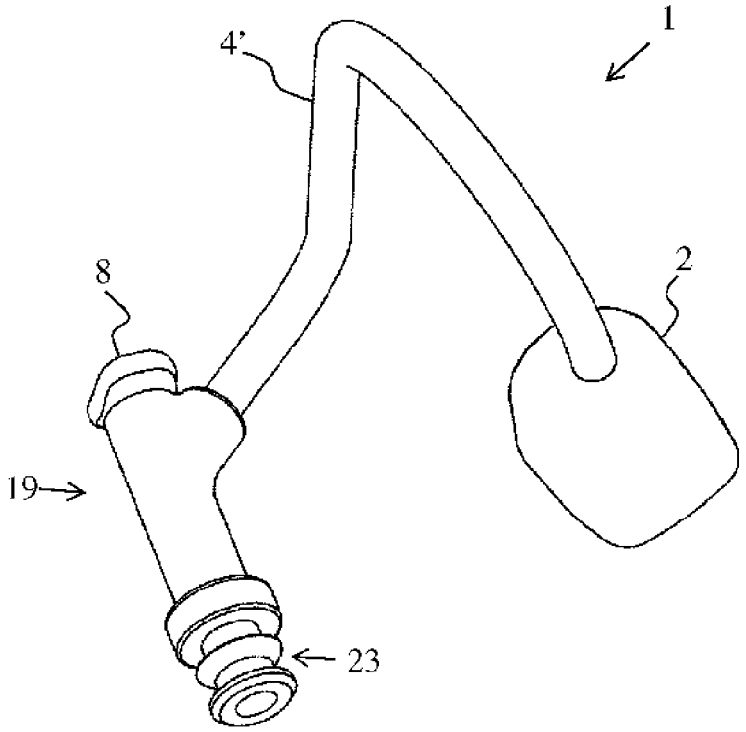
FIG. 5 illustrates a part of an in-the-canal part connected through a sound tube to a behind-the-ear part.

FIG. 5 shows a hearing aid 1 with a behind-the-ear part 2 and the connector part 19 of an in-the-ear part 3. The connector part 19 is connected to the behind-the-ear part 2 through a sound tube 4'. The connector in this example comprises the second end 8 of the in-the-ear part. The connector 19 comprises an adaptor 23 for connecting to an ear plug or ear mold, thereby forming an in-the-ear part 3. It is seen from FIG. 5 that the sound tube 4' will extend from the connector 19, and thereby from an in-the-ear part, in an angle in the range 20-70 degrees, and that it is attached to and is extending from a side wall of the connector.

Figure 6:
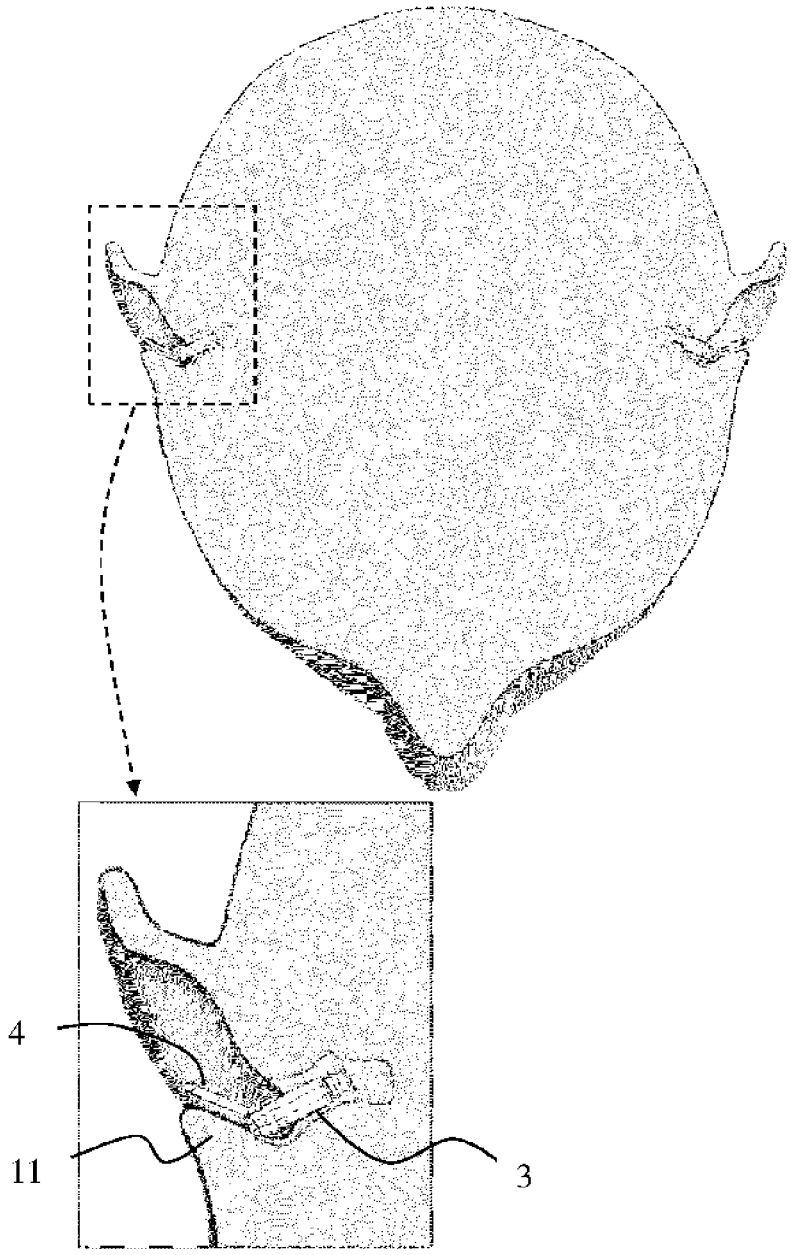
FIG. 6 illustrates a horizontal cross sectional view through both ear canals, and showing the position of in-the-ear parts of the hearing aids.

FIG. 6 shows a horizontal cross sectional view of a head of a person in upright position. The cross sectional view goes through both ear canals and illustrates the position of in-the-ear parts 3 of hearing aids. The view is seen from above the upright standing person (holding the head in a neutral position, i.e. looking straight ahead). An enlarged view of the right ear with the in the-ear-part 3 is also shown. It is seen how the in-the-ear part is arranged partly in the ear canal and with an end extending out of the ear canal and abutting against the tragus 11. It is seen that the connecting part 4 extends from the in-the-ear part 3 in a direction opposite or substantially opposite the direction towards the ear canal, or it could be described as a direction pointing away from the scull of the person wearing the hearing aid.

It is indicated from FIG. 6 that the connecting part 4 is attached to a side wall prepared for being arranged vertically when the in-the-ear part 3 is arranged in the ear of a person standing in an upright position. The connecting part extends parallel or substantially parallel with the surface of the tragus part facing the ear canal, as the connecting part extends in a direction pointing away from or in the opposite direction of the ear canal.

Figure 7:
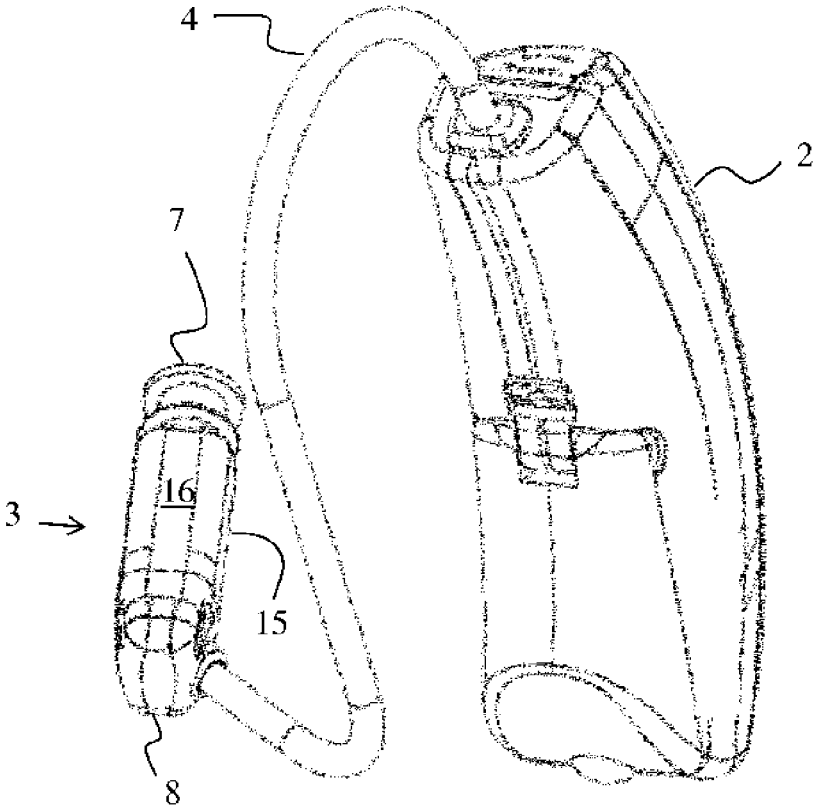
FIG. 7 illustrates a hearing aid intended for the left ear of a person.

FIG. 7 shows a hearing aid prepared for being arranged at the left ear of a person. This figure shows how the connecting part 4 extends from a side wall 15 of the in-the-ear part. This side wall is prepared to be arranged vertically or substantially vertical when the hearing aid is arranged at the ear of an upright standing person.

We claim:

1. A hearing aid comprising a behind-the-ear part adapted to be arranged behind the ear of a hearing aid user, an in-the-ear part adapted to be arranged at least partially in the ear canal, said in-the-ear part comprising a first end surface in which a sound opening for guiding the sound from the hearing aid in the direction of the ear drum is arranged, and a second end surface, which is the surface situated furthest away from the first end surface, and a connecting part connecting the behind-the-ear part and the in-the-ear part, wherein said first end surface is adapted to be aligned in the ear canal in a direction towards the ear drum when in use, and said second end surface is adapted to abut a part of the ear outside the ear canal when in use, wherein at least one side wall is arranged between said first end surface and said second end surface, and wherein said connecting part is attached to said side wall and has a part that extends from said side wall in an angle of between 20-70 degrees from an axis extending from a center of the first end surface to a center of the second end surface.

2. The hearing aid according to claim 1, wherein said second end surface of said in-the-ear part is adapted to abut the tragus part of the outer ear.

3. The hearing aid according to claim 1, wherein said connecting part is extending from a side wall adapted to be arranged vertically, or substantially vertically, when said hearing aid is arranged on a person standing in an upright position.

4. The hearing aid according to claim 1, wherein said connecting part is adapted to extend parallel or substantially parallel to a surface of the tragus part of the ear when said hearing aid is in use.

5. The hearing aid according to claim 1, wherein said connecting part is adapted for when in use extending from said in-the-ear part in a direction away from or substantially away from the ear canal.

6. The hearing aid according to claim 1, adapted to be arranged at the ear without the use of an anchor.

7. The hearing aid according to claim 1, adapted to be arranged at the ear without any supporting elements in the concha part of the ear other than said second end surface abutting a part of the ear outside the ear canal and said connecting part.

8. The hearing aid according to claim 1, wherein a receiver is arranged in said in-the-ear part, and wherein said connecting part comprises an electrical wire connecting said receiver with said behind-the-ear part.

9. The hearing aid according to claim 1, wherein said connecting part extends from said side wall in an angle between 30 and 60 degrees.

10. The hearing aid according to claim 1, wherein said connecting part extends from said side wall in an angle between 40 and 50 degrees.

11. The hearing aid according to claim 8, wherein said receiver is provided with an extension part at said second end surface, said extension part being adapted to abut said part of the ear outside the ear canal when in use.

12. The hearing aid according to claim 1, wherein said connecting part is extending from said side wall adjacent said second end surface.

13. A receiver unit for a hearing aid, said receiver unit comprising a first end adapted to be aligned in the ear canal in a direction towards the ear drum when in use, a second end adapted to abut a part of the ear outside the ear canal when in use, and at least one side wall arranged between said first end and said second end, wherein an electrical wire is attached to said side wall and extends from said side wall in an angle of between 20 and 70 degrees to an axis extending from a center of the first end to a center of the second end.

14. The receiver according to claim 13, wherein said electrical wire extends from said side wall in an angle between 30 and 60 degrees.

15. The receiver according to claim 13, wherein said second end of said receiver part is adapted to abut the tragus part of the outer ear.

16. A method for fitting a hearing aid a hearing aid comprising a behind-the-ear part adapted to be arranged behind the ear of a hearing aid user, an in-the-ear part adapted to be arranged at least partially in the ear canal, said in-the-ear part comprising a first end surface in which a sound opening for guiding the sound from the hearing aid in the direction of the ear drum is arranged, and a second end surface, which is the surface situated furthest away from the first end surface, and a connecting part connecting the behind-the-ear part and the in-the-ear part, wherein said first end surface is adapted to be aligned in the ear canal in a direction towards the ear drum when in use, and said second end surface is adapted to abut a part of the ear outside the ear canal when in use, wherein at least one side wall is arranged between said first end surface and said second end surface, and wherein said connecting part is attached to said side wall and has a part that extends from said side wall in an angle of between 20-70 degrees from an axis extending from a center of the first end surface to a center of the second end surface, comprising the steps of arranging the behind-the-ear part behind an ear of said person, shaping a connecting part connecting said behind-the-ear part to an in-the-ear part, such that said connecting part fits the outer ear of said person, and arranging said in-the-ear part at the entrance of the ear canal such that said in-the-ear part abuts the tragus part of the outer ear.

17. The hearing aid according to claim 1, wherein said sidewall is an exterior side wall of said in-the-ear part.

18. The receiver unit according to claim 13, wherein said sidewall is an exterior side wall of said receiver unit.

19. The method according to claim 16, wherein said sidewall is an exterior side wall of said in-the-ear part.

* * * * *